United States Patent [19]

Rohde et al.

[11] Patent Number: 4,771,677

[45] Date of Patent: Sep. 20, 1988

[54] AXIAL PISTON MACHINE

[75] Inventors: Rolf Rohde, Elchingen; Herbert Kurz, Ulm, both of Fed. Rep. of Germany

[73] Assignee: Hydromatik GmbH, Fed. Rep. of Germany

[21] Appl. No.: 816,275

[22] Filed: Jan. 6, 1986

[30] Foreign Application Priority Data

Feb. 1, 1985 [DE] Fed. Rep. of Germany ..... 3503437

[51] Int. Cl.[4] ..... F01B 13/04

[52] U.S. Cl. ..... 92/57; 92/71; 92/147; 91/507; 384/906; 74/60

[58] Field of Search ..... 92/12.2, 31, 57, 71, 92/147, 128, 161, 165 PR; 74/60; 417/269; 91/499, 507; 384/906

[56] References Cited

U.S. PATENT DOCUMENTS

| | | | |
|---|---|---|---|
| 2,061,144 | 11/1936 | Stoutz | 91/507 |
| 2,459,786 | 1/1949 | Beaman et al. | 91/507 |
| 2,776,627 | 1/1957 | Keel | 91/507 |
| 2,915,974 | 12/1959 | Enemark | 91/499 |
| 2,987,046 | 6/1961 | Atherton | 92/128 |
| 3,007,420 | 11/1961 | Budzich | 91/507 |
| 3,177,665 | 4/1965 | Power | 91/499 |
| 3,495,543 | 2/1970 | Millard | 92/128 X |

FOREIGN PATENT DOCUMENTS

| | | | |
|---|---|---|---|
| 584665 | 9/1933 | Fed. Rep. of Germany | 91/499 |
| 140375 | 12/1978 | Fed. Rep. of Germany | 91/499 |
| 791992 | 3/1958 | United Kingdom | 91/507 |
| 1135950 | 12/1968 | United Kingdom . | |

*Primary Examiner*—Robert E. Garrett
*Assistant Examiner*—Mark A. Williamson
*Attorney, Agent, or Firm*—Scully, Scott, Murphy & Presser

[57] ABSTRACT

The invention relates to an axial piston machine having an oblique disk body (14) arranged in a housing (1) in a torsionally secure manner, having a drive shaft (4), which is mounted in the oblique disk body (14), and having a rotatable cylinder drum (7), which is coupled with the drive shaft (4) and in which a plurality of pistons (9) may be displaced axially in piston bore holes, their piston heads (11) being supported by means of sliding shoes (12) against the oblique surface (13) of the oblique disk body (14). The purpose of the invention is to construct the axial piston machine in such a way as to make possible torsional securement of the oblique disk body (14) which is simple in terms of production techniques and assembly, with a compact constructional form. This is achieved by mounting the oblique disk body (14) with its peripheral surface (16, 17) torsionally secured in a form-locking manner in a recess (19) of the housing (1) shaped to correspond to the peripheral surface (16, 17).

6 Claims, 2 Drawing Sheets

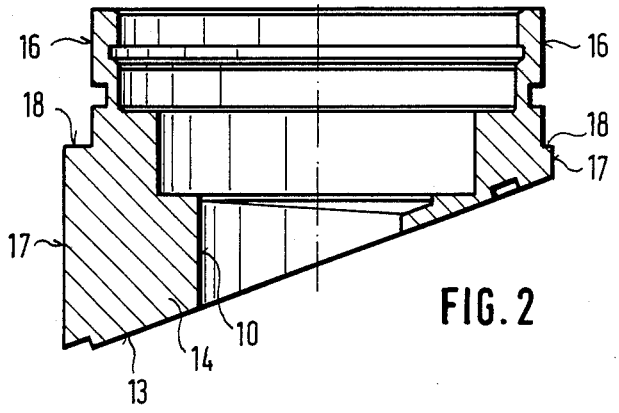
FIG. 2
FIG. 3
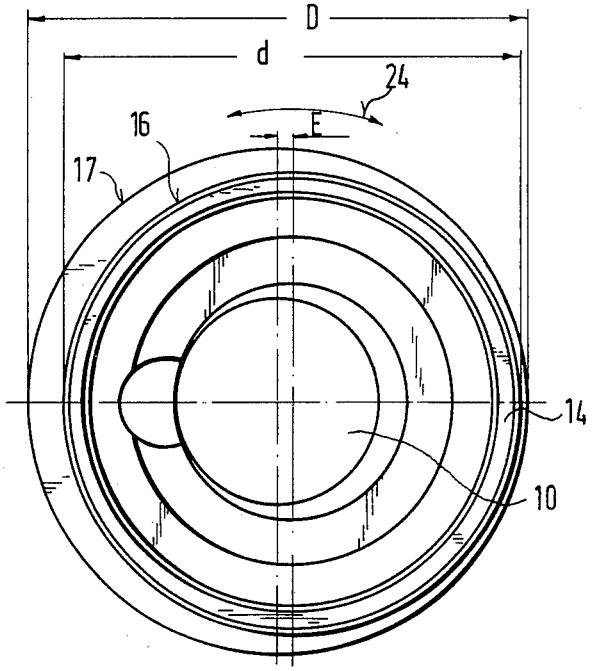

AXIAL PISTON MACHINE

TECHNICAL FIELD OF THE INVENTION

The invention relates to an axial piston machine according to the preamble of claim 1.

BRIEF DESCRIPTION OF THE PRIOR ART

An axial piston machine of this type is described and represented in U.S. Pat. No. 3,177,665 (cf. FIG. 1A). In the case of this known construction, the necessary torsional securement of the oblique disk body is established by means of threaded screws which are set through a flange of the housing of the axial piston machine axially from outside and which are screwed into the oblique disk body. The oblique disk body is not only torsionally secured in this manner, but is also simultaneously fixed on the flange of the housing.

This known construction is disadvantageous for several reasons. One important disadvantage lies in the fact that several additional parts are required for the torsional securement, calling for comparatively great production costs not just for themselves, but also with regard to the shaping which they necessitate in the housing and in the oblique disk body (through holes, threaded holes). The arrangement of the threaded screws results, moreover, in a larger constructional form.

OBJECT OF THE INVENTION

The underlying object of the invention is to design an axial piston machine of the type described by way of introduction in such a way that torsional securement which is simple in terms of production techniques and assembly is achieved with a compact constructional form.

SUMMARY OF THE INVENTION

This object is achieved through the characteristics given in claim 1.

The construction according to the invention results in several advantages. Since the torsional securement acts on the peripheral surface of the oblique disk body there is, because the effective distance is relatively great, comparatively little strain in the peripheral direction of the oblique disk body, so that the surface pressure is comparatively low. In the case of axial piston machines of the present type it can be assumed that the oblique disk body has to accommodate considerable strain in the peripheral direction, particularly when the axial piston machine is set in operation abruptly. In the case of the known construction the effective distance provided by the radius of the oblique disk body cannot be utilized. Moreover, on account of the necessary play of the threaded screws in the through holes of the housing flange and also in the threaded holes of the oblique disk body, stable torsional securement can only be realized with threaded screws of high tensional force, that is to say, large threaded screws, which for the reasons pointed out at the beginning result in further disadvantages.

A further advantage of the construction according to the invention is that the torsional securement does not involve any additional component parts, but is effected merely by the shaping of the oblique disk body and of the housing. All that is required is for the non-circular periphery of the oblique disk body to be set into the correspondingly shaped recess in the housing, whereby the torsional securement is brought about automatically by the form-locking surfaces present. The construction according to the invention thus forms a simple solution that is inexpensive to produce and easy to assemble.

The construction according to claim 2 provides a means of restraining the oblique disk body in the direction away from the cylinder drum. A suitable stopping surface can be provided in an advantageous manner by the base of the recess.

In a further development of the invention according to claim 3 no special axial securement to prevent the oblique disk body from being displaced towards the cylinder drum is provided in the region of the recess. With this construction, this axial securement is effected by the piston-sliding shoe arrangement, which is preferably under spring tension acting towards the recess, so that when the axial piston machine is in operation, the forces supporting the pistons likewise effect axial securement acting in the same direction. The axial piston machine is further simplified by this further development, because the absence of axial securement in the region of the recess allows the oblique disk body to be simply pushed into the recess for the purpose of assembly and to be simply removed for the purpose of disassembly. Securement in the previously specified axial direction results automatically from the action of the piston-sliding shoe arrangement.

The advantage of the construction according to claim 3 is that it involves peripheral surfaces extending over a large part of the periphery which act in the peripheral direction in a form-locking manner. In this way, a comparatively low surface pressure can be achieved.

The further development according to claim 4 results in a shape of both the oblique disk body and the housing which can be realized simply and inexpensively. Moreover, this further development makes possible a mutual arrangement of the cylindrical peripheral surfaces in which, on account of drawing contact of the form-locking surfaces, a comparatively soft impact can be realized when there is action upon the oblique disk body in either peripheral direction. A preferred exemplary embodiment of this further development is contained in claim 5. On account of some play in the recess, which facilitates assembly and disassembly respectively, a certain eccentricity is required between the cylindrical peripheral surfaces in order to prevent the oblique disk body from getting jammed in the recess as a result of a movement in the peripheral direction.

The construction according to claim 6 automatically results in securement against axial displacement of the oblique disk body in the direction away from the cylinder drum. On account of the step between the cylindrical peripheral surfaces of the oblique disk body and the recess, there is with this construction axial securement through abutment of the stepped surface on the oblique disk body against the stepped surface on the housing.

The development according to the invention and all the further developments have another advantage in common which is of considerable significance in view of the considerable loads acting on the oblique disk body when the axial piston machine is in operation. On account of the play between the peripheral surface of the oblique disk body and the peripheral surface of the recess, a free space is formed which is filled with oil when the axial piston machine is in operation. With the blows (possibly alternating) acting on the oblique disk body in the peripheral direction when the axial piston pump is in operation, this oil film acts as a hydraulic damper between the peripheral surfaces thereby reducing peak strains and prolonging the working life of the axial piston machine as a whole.

The construction according to the invention is suitable both for axial piston pumps with constant delivery volume, for those with variable delivery volume, and also for those in which the direction of rotation is reversible. In the last two cases, a swivel bearing and an adjusting mechanism are required in order to slew the oblique disk. In such cases, the term oblique disk body embraces not only the oblique disk itself, but also the base plate on which the latter is supported as a slewable part on the housing.

It is to be noted in addition that the construction according to the invention is suitable for the pump and the motor operation of axial piston machines.

BRIEF DESCRIPTION OF THE DRAWINGS

An exemplary embodiment of the invention is described in the following with the aid of a simplified drawing, in which:

FIG. 2 shows a longitudinal section through the oblique disk body of the axial piston machine;

FIG. 3 shows a top view of the oblique disk body according to FIG. 2.

DETAILED DESCRIPTION OF THE PREFERRED EMBODIMENT OF THE INVENTION

Figure 1:
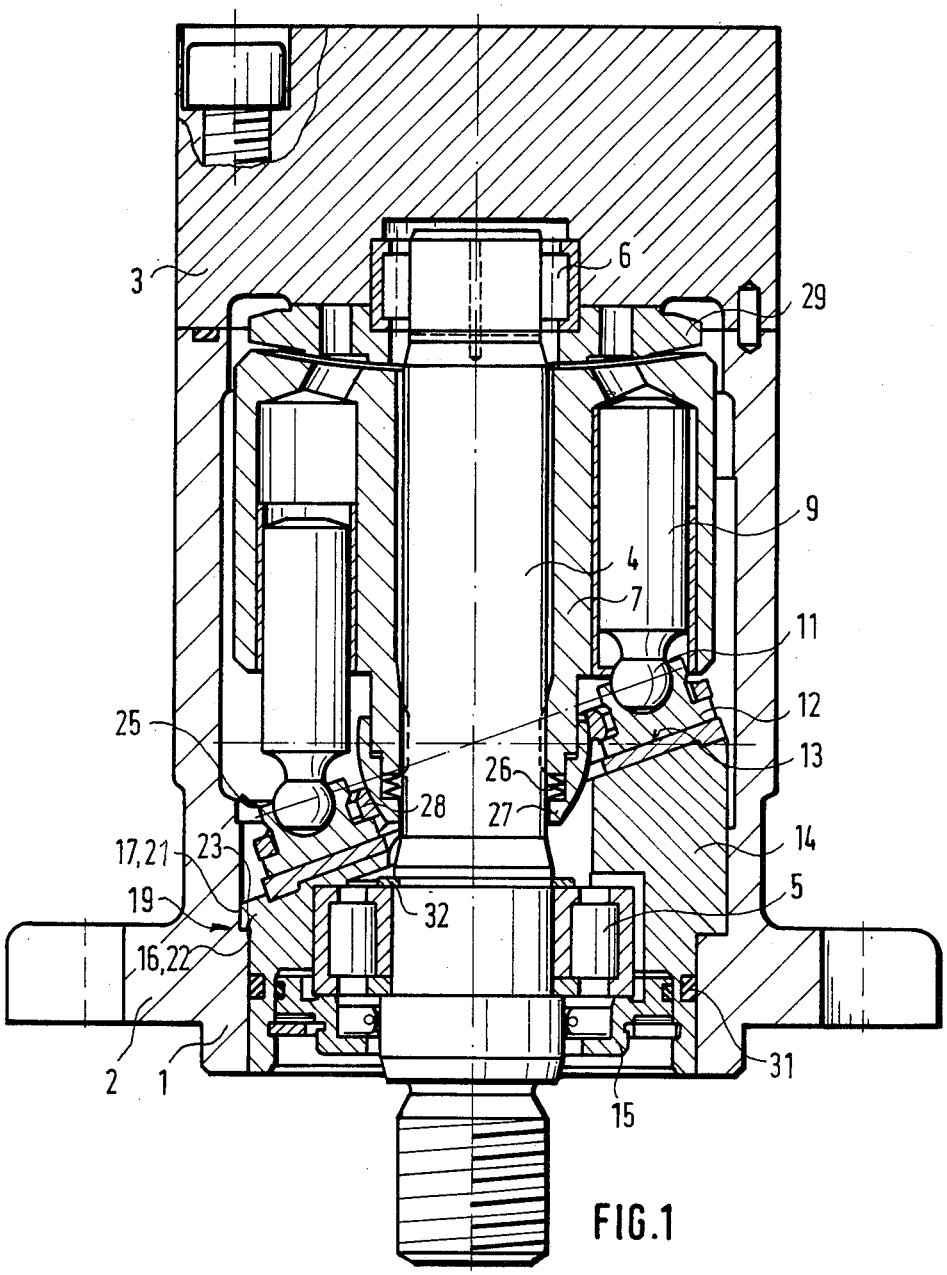
FIG. 1 shows a longitudinal section through a hydrostatic axial piston machine constructed according to the invention.

The axial piston machine consists of a housing 1 with a fixing flange 2 and a housing cover 3 at the end opposite the fixing flange 2. In the housing 1 there is mounted in roller bearings 5, 6 a drive shaft 4 which extends axially and upon which a cylinder drum 7 is mounted, inside the housing 1, in a torsionally secure manner, said cylinder drum having, on a pitch circle, a plurality of cylinder bores which extend axially and in which pistons 9 may be displaced. The pistons have, at their ends facing the fixing flange 2, piston heads 11 which are accommodated in a known manner in sliding shoes 12 and which are supported by these sliding shoes 12 axially against the oblique surface 13 of an oblique disk 14 through which the drive shaft 4 passes via an opening 10. The oblique disk 14, in which the roller bearing 5 is accommodated for the purpose of mounting the drive shaft 4 and is secured by means of a bearing cover 15, has two cylindrical peripheral surfaces 16, 17 with different diameters d, D arranged eccentrically in respect of each other. The eccentricity is denoted by E in FIG. 3.

The cylindrical peripheral surface 16 of smaller diameter is further away from the oblique surface 13 than the larger cylindrical peripheral surface 17. The ratio of diameters is approximately 1:1.15. Thus, the smaller cylindrical peripheral surface 16 - viewed axially - is arranged within the larger cylindrical peripheral surface 17 in such a way that a shoulder results,in the form of a stepped surface 18 on the entire surface of the oblique disk 14.

The housing 1 has, for the purpose of accommodating the oblique disk 14, a recess which is generally denoted by 19 and which is stepped in diameter, the cylindrical inner peripheral surface 21 with the greater diameter, the cylindrical inner peripheral surface 22 with the smaller diameter, and the shoulder between these two in the form of a stepped surface 23 corresponding, because of the same eccentricity E, to the form of the relevant surfaces on the oblique disk 14. The oblique disk 14 can therefore be inserted into the recess 19 from inside so as substantially to close it, so that, because of the eccentric arrangement of the peripheral surfaces 16, 22; 17, 21 and the presence of the stepped surfaces 18, 23, the oblique disk 14 is secured both torsionally in the peripheral direction 24 and axially in the direction away from the cylinder drum 7.

Special axial securement acting towards the cylinder drum 7 is not required in the region of the recess 19, because when the axial piston pump is in operation the piston-sliding shoe arrangement generally denoted by 25 acts upon the oblique disk 14 towards the stepped surfaces 18, 23 and thus secures it in position. In addition, there is a pressure spring 26 which acts upon the piston-sliding shoe arrangement 25 towards the oblique disk 14, so that it is supported against the cylinder drum 7 and acts thereon by means of a dome-shaped, axially displaceable sleeve 27 and a holding plate 28 for the sliding shoes 12.

The cylinder drum 7, which is mounted on the drive shaft 4 so that it is torsionally secured but axially displaceable, is simultaneously urged against the control surface of a control disk by the pressure spring 26. The control disk 29 and the suction and pressure lines extending through it basically correspond to standard constructions and do not therefore have to be described.

During operation the oblique disk is urged in the peripheral direction 24 because of the oblique surface 14 and rotational movement of the cylinder drum 7. The torsional securement of the oblique disk 14 is ensured by the eccentric arrangement of the peripheral surfaces 16, 22; 17, 21, which are shaped as form-locking surfaces extending transverse to the peripheral direction 24. On account of the eccentricity E, drag contact thereby results between these peripheral surfaces, equivalent to a damped impact. There is further hydraulic damping owing to the fact that the oil film present between these peripheral surfaces has a damping action. The oil film can continue between the peripheral surfaces 16, 21; 17, 22 because the sealing ring 31 for sealing the oblique disk 14 is arranged on the outside of the peripheral surface 16, 22; 17, 21.

The assembly or disassembly of the oblique disk 14 takes place through the opening of the housing 1, which may be closed by the cover 3 and which is of corresponding size.

The drive shaft 4 is secured in the oblique disk 14 by means of the bearing 5 against displacement in both axial directions, on the one hand by the bearing cover 15 and on the other hand by a securing ring 32. In this way, the oblique disk 14 and the drive shaft 4, with or without the cylinder drum 7 and the piston-sliding shoe arrangement 25, form a constructional unit which may be pre-assembled.

What is claimed is:

1. An axial piston machine comprising: an oblique disk body arranged in a housing in a torsionally secure manner; a drive shaft mounted in the oblique disk body; and a rotatable cylinder drum coupled with the drive shaft and in which a plurality of pistons may be displaced axially in piston bore holes, their piston heads being supported by means of sliding shoes against the oblique surface of the oblique disk body, said oblique disk body having two cylindrical peripheral surfaces which lie one after the other in the axial direction and which are arranged eccentrically (E) with respect to each other, said peripheral surfaces being torsionally secured in a form-locking manner in a recess in the housing shaped to correspond to said peripheral surfaces.

2. An axial piston machine according to claim 1, characterised by an abutment surface which extends transverse to the axial direction for the purpose of restraining the oblique disk body in the direction away from the cylinder drum.

3. An axial piston machine according to claim 2, characterized in that the cylindrical peripheral surfaces have different diameters (d, D) and the smaller peripheral surfaces are arranged inside an imaginary envelope formed by the larger peripheral surface.

4. An axial piston machine according to claim 3, characterized in that the cylindrical peripheral surface, which is more remote from the oblique surface, is the one with the smaller diameter (d).

5. An axial piston machine according to claim 2, characterised in that the cylindrical peripheral surface, which is more remote from the oblique surface, is the one with the smaller diameter (d).

6. An axial piston machine according to claim 2, characterized in that the oblique disk body is held, against displacement towards the cylinder drum, merely by the piston-sliding shoe arrangement and optionally by a spring which urges the said piston-sliding shoe arrangement towards the recess.

* * * * *